United States Patent [19]

Bandukwalla

[11] 4,378,194

[45] Mar. 29, 1983

[54] CENTRIFUGAL COMPRESSOR

[75] Inventor: Phiroze Bandukwalla, North Syracuse, N.Y.

[73] Assignee: Carrier Corporation, Syracuse, N.Y.

[21] Appl. No.: 193,507

[22] Filed: Oct. 2, 1980

[51] Int. Cl.[3] ..... F04D 27/00; F04D 29/46

[52] U.S. Cl. ..... 415/49; 415/146; 415/158; 415/211

[58] Field of Search ..... 415/49, 146, 211, 28, 415/158, 148, 165, 157

[56] References Cited

U.S. PATENT DOCUMENTS

| | | | |
|---|---|---|---|
| 2,861,774 | 11/1958 | Buchi | 415/158 X |
| 2,933,237 | 4/1960 | Darrow et al. | 415/146 X |
| 2,996,996 | 8/1961 | Jassniker | 103/97 |
| 3,032,259 | 5/1962 | Jassniker | 230/114 |
| 3,204,863 | 9/1965 | Hausamann | 415/158 X |
| 3,228,656 | 1/1966 | Kyogoku | 415/158 X |
| 3,245,399 | 4/1966 | Lawson | 415/158 X |
| 3,365,120 | 1/1968 | Jassniker | 415/158 X |
| 3,426,964 | 2/1969 | Silvern | 230/114 |
| 3,588,270 | 6/1971 | Boelcs | 415/DIG. 1 X |
| 3,784,318 | 1/1974 | Daris | 415/158 |
| 3,799,694 | 3/1974 | Duzan | 415/161 |
| 3,957,392 | 5/1976 | Blackburn | 415/146 |
| 3,972,642 | 8/1976 | Fricke et al. | 415/158 X |
| 4,219,305 | 8/1980 | Mount et al. | 415/13 |
| 4,257,733 | 3/1981 | Bandukwalla et al. | 415/13 |

FOREIGN PATENT DOCUMENTS

| | | | |
|---|---|---|---|
| 712406 | 10/1941 | Fed. Rep. of Germany | 415/49 |
| 277111 | 11/1951 | Switzerland | 415/28 |
| 388220 | 6/1965 | Switzerland | 415/158 |
| 696817 | 9/1953 | United Kingdom | 415/158 |

*Primary Examiner*—Everette A. Powell, Jr.

*Attorney, Agent, or Firm*—Donald F. Daley; David J. Zobkiw

[57] ABSTRACT

The efficiency of a centrifugal compressor is optomized over a wide range of flow rates by providing a diffuser which is a combination of fixed vanes and a movable wall member and which throttles the diffuser passage in accordance with compressor load.

8 Claims, 6 Drawing Figures

CENTRIFUGAL COMPRESSOR

BACKGROUND OF THE INVENTION

This invention relates to centrifugal turbomachines, and, more specifically, to diffuser structure for use in such devices.

In centrifugal turbomachines such as gas compressors, the kinetic energy of the flowing medium which is issuing at high speed from the impeller is converted into pressure energy and the efficiency and stability of the compressor is dependent upon the means for converting the kinetic energy into static pressure. One of the major problems arising in the use of centrifugal gas compressors for applications where the compression load varies over a wide range is flow stabilization through the compressor. The compressor inlet, impeller, and diffuser passage must be sized to provide for the maximum volumetric flow rate desired. In centrifugal refrigerant compressors, the loads typically vary over a wide range and they may be operated at such low flow rates that their diffusers are too large for efficient operation. When there is a low volumetric flow rate through such a compressor, the flow becomes unstable. As the volumetric flow rate is decreased from a stable range, a range of slightly unstable flow is entered. In this range, flow in both the impeller and diffuser becomes separated from the wall along the entire length of the flow passage and there appears to be a partial reversal of flow in the diffuser passage creating noises and lowering the compressor efficiency. Below this range, the compressor enters what is known as surge, wherein there are periodic complete flow reversals in the diffuser passage, destroying the efficiency of the machine.

Many high-performance centrifugal stages employ a fixed vane diffuser section to achieve the kinetic energy conversion since a vaned diffuser is more efficient at designed incidence than a vaneless diffuser. The low flow limit corresponds to the onset of a surge or stall condition which occurs as the fluid flow from the impeller becomes more tangential as the flow decreases. This produces a large flow angle and magnitude with respect to the leading edge of the fixed diffuser vanes, creating a violet instability. The high flow limit corresponds to a choke condition caused as increasing fluid flow from the impeller becomes more radial and finally chokes the diffuser throat with very large kinetic energy loss. Since a vaneless diffuser has better off-design performance than a vaned diffuser, because it does not suffer from incidence losses, it is often chosen where there is considerable off-design operation.

Various techniques have been used to increase the range between the surge and choke limits of a compressor. Guide vanes in the inlet of the compressor have been employed to vary the flow direction and quantity of entering gas. Movable diffuser vanes have also been employed to permit alignment of the vanes with the changing flow direction as the flow rate changes.

SUMMARY OF THE INVENTION

In accordance with the present invention, a fixed vane diffuser is provided in combination with a movable wall diffuser or throttle ring. In addition, the wakes and jets are mixed out after passing through the fixed diffuser but before entering the scroll.

It is an object of this invention to provide a method and apparatus for varying the capacity of a centrifugal compressor in order to provide a large range of stable flow rates.

It is another object of this invention to provide a centrifugal gas compressor having means therein to stabilize the gas flow therethrough at extremely low flow rates.

It is a further object of this invention to provide a centrifugal compressor in which the compressor efficiency is optimized over a wide range of flow rates.

It is another object of this invention to improve scroll efficiency.

It is an additional object of this invention to provide a centrifugal compressor having a diffuser with a movable wall for varying the cross-sectional area of the diffuser.

It is a yet still further object of this invention to provide a centrifugal compressor having a self-adjusting throttle ring. These objects and others as will become apparent hereinafter, are accomplished by the present invention.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
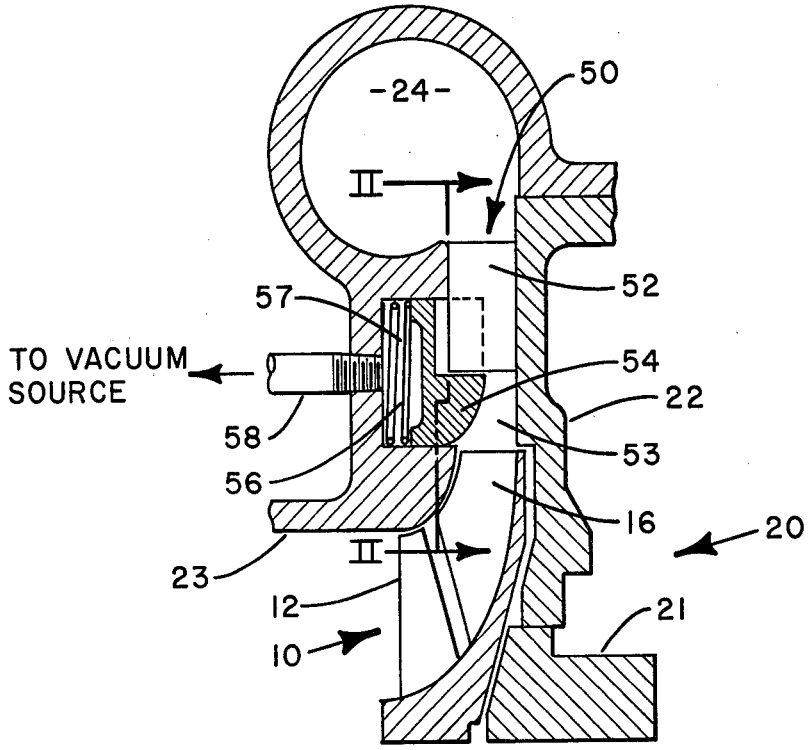
FIG. 1 is a partial sectional view of a compressor employing the diffuser structure of the present invention.
Figure 2:
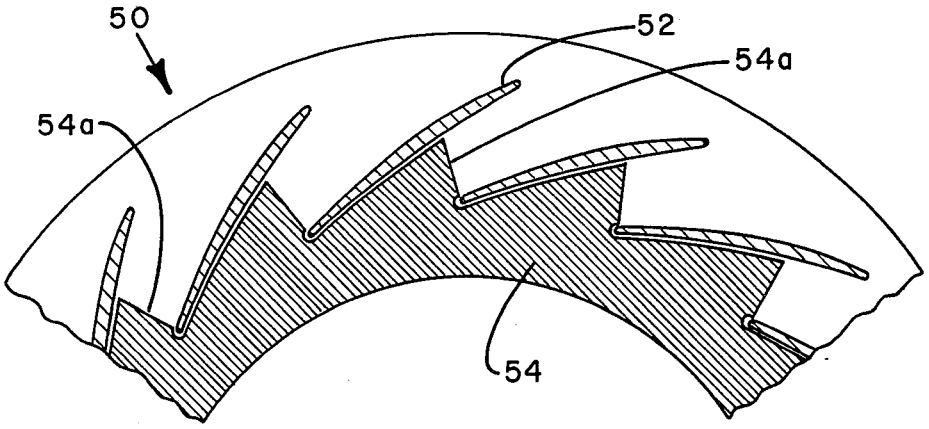
FIG. 2 is a sectional view taken along line II—II of FIG. 1.

In FIG. 1 the numeral 10 generally designates the impeller of a centrifugal compressor and the numeral 20 generally designates the centrifugal compressor. Housing 22 defines an inlet 23 and a scroll-shaped outlet passage 24 which is downstream and separated from the impeller 10 by diffuser 50. The diffuser 50 includes a plurality of fixed vanes 52 which are located downstream of movable throttle ring member 54. As best shown in FIG. 2, the movable throttle ring 54 has serrations **54*a* along its circumferential surface so as to receive the fixed vanes 52. Throttle ring 54 is sealingly received in chamber 57 where throttle ring 54 acts as a piston under the influence of spring 56 and fluid pressure supplied to chamber 57 via line 58 as well as static and dynamic pressure forces in diffuser passage 53**.

Figure 3:
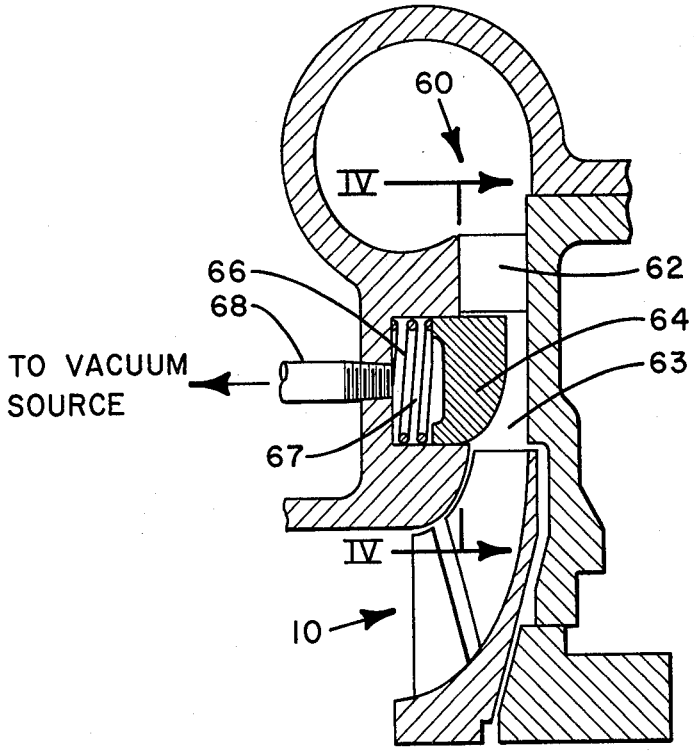
FIG. 3 is a partial sectional view of a first modified diffuser.
Figure 4:
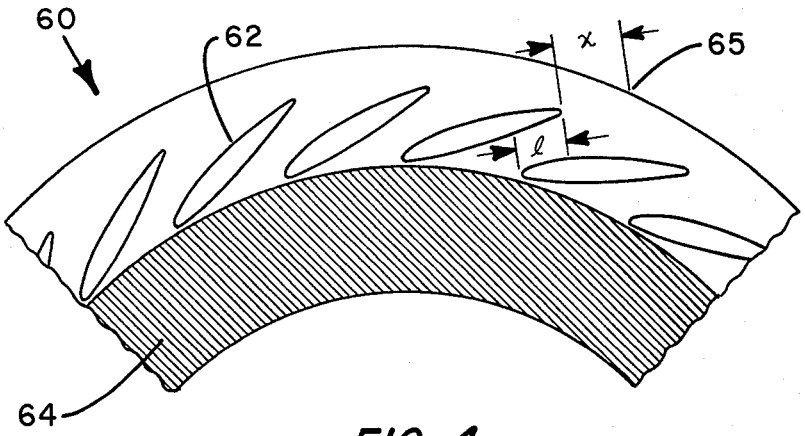
FIG. 4 is a sectional view taken along line IV—IV of FIG. 3.

The diffuser 60 of FIGS. 3 and 4 includes a plurality of fixed vanes 62 which are located downstream of movable throttle ring member 64. Throttle ring 64 is sealingly received in chamber 67 where throttle ring 64 acts as a piston under the combined influence of spring 66, fluid pressure (vacuum) in chamber 67 which is supplied via line 68, and the static and dynamic pressure forces in diffuser passage 63.

Figure 5:
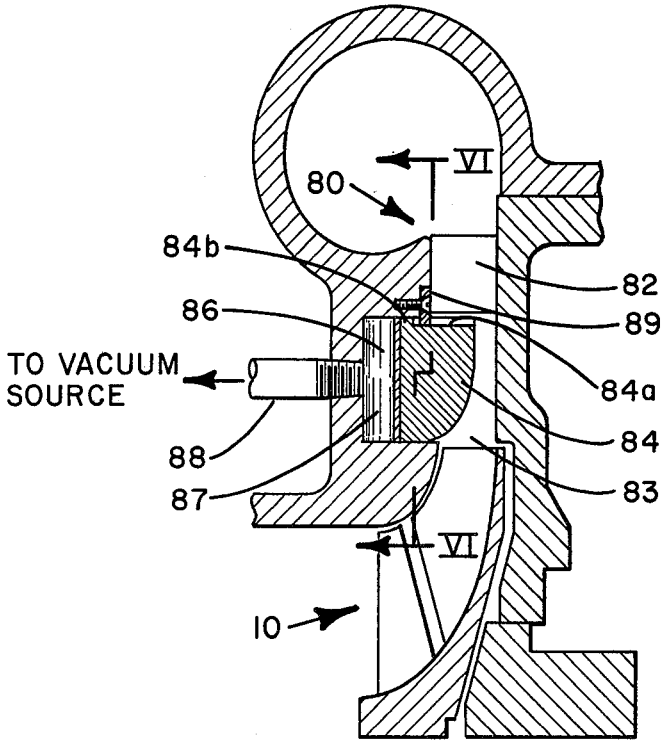
FIG. 5 is a partial sectional view of a second modified diffuser.
Figure 6:
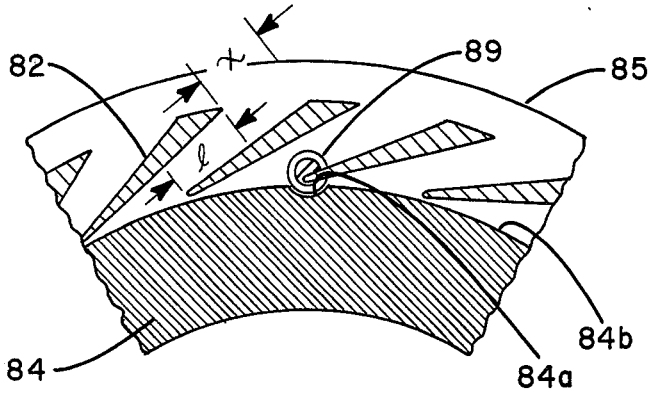
FIG. 6 is a sectional view taken along line VI—VI of FIG. 5.

The diffuser 80 of FIGS. 5 and 6 is similar to the diffuser 60 of FIGS. 3 and 4. Throttle ring member 84 is sealingly located in chamber 87 and is prevented from both axial and rotational movement by stops 89 which are located equispaced around the periphery of the throttle ring 84 and extending into grooves 84*a* formed in throttle ring 84. Stops 89 coact with base 84*b* formed on throttle ring 84 to limit the closing movement of the throttle ring 84. Fixed wedges 82 are located downstream of the throttle ring 84. Annular leaf spring 86 tends to bias the throttle ring 84 into the diffuser passage 83 against the static and dynamic pressure in passage 83 and the evaporator pressure (vacuum) supplied to chamber 87 via line 88.

OPERATION

Centrifugal compressors have poorer efficiency as compared to axial compressors primarily because of the poor aspect ratios (base/height) and less than optimal airfoil blade shape, especially in the inlet region.

Even though it is more lightly loaded in the inducer portion than an axial compressor, a conventional centrifugal compressor has less range.

As best shown in FIG. 1, the impeller 10 of centrifugal compressor 20 is rotated via shaft 21 by conventional driving means (not illustrated). The fluid entering the inlet 23 of compressor 20 serially passes through the inducer section 12, the rest of impeller 16, diffuser 50 and then into scroll-shaped outlet passage 24. The diffuser 50 of FIGS. 1 and 2 serially includes an adjustable throttle ring 54 and fixed vanes 52. Throttle ring 54 is positioned by a spring 56 to throttle the flow from the compressor in accordance with demand before the flow reaches fixed vanes 52 and in opposition to the static pressure, dynamic pressure and evaporator pressure which tend to oppose the throttling action of spring 56 and thereby cause throttle ring 54 to be positioned in response to compressor loading and demand. Fixed vanes 52 of diffuser 50 provide a more efficient diffuser at design incidence than a vaneless diffuser. However, the high efficiency range of a vaned diffuser is extended by varying the width of diffuser 50 with load, thus maintaining a constant inlet air angle to the fixed vanes 52. The variations of the diffuser passage 53 may be continuous with load or, in the interest of cost saving, can vary in a finite number of steps. This method of control is superior to a variable vaned diffuser because it offers a constant exit angle into scroll-shaped outlet passage 24 and hence optimum scroll efficiency and range and, in addition, is cheaper than a variable vaned diffuser. The scroll efficiency also depends upon the mixing out of wakes and jets as noted below more specifically with respect to the devices of FIGS. 3–6. Static pressure in diffuser passage 53 will be a function of the compressor output and will tend to move throttle ring 54 to the left as viewed in FIG. 1 so as to increase the area of diffuser passage 53. The dynamic pressure of the issuing fluid will also result in a leftward force being exerted on throttle ring 54 and this force is opposed by spring 56, or the like, which is located in chamber 57. Additionally, by connecting line 58 to a vacuum (not illustrated), such as the evaporator of the refrigeration system, an additional load related opening force will be exerted against the force of the spring 56. Thus, static pressure, dynamic pressure and evaporator pressure are all used to provide an opening force to widen diffuser passage 53 in opposition to the force of spring 56.

The diffuser 60 of FIGS. 3 and 4 is similar in operation to diffuser 50 of FIGS. 1 and 2. Because the fixed vanes 62 are separated from movable throttle ring 64, the throttle ring 64 is free to rotate tangentially to present the same air inlet angle to the fixed diffuser vanes 62. Throttle ring 64 is positioned by a spring 66 as well as the static, dynamic and evaporator pressures acting thereon. The scroll efficiency is improved by mixing out the wakes and jets. With a vaned island diffuser having vanes 62, the preferred distance (x) for mixing out the wakes and jets is one half of the cover length (l) and represents the distance to the tongue 65 of the scroll. These distances would also be correct for diffuser 50 of FIGS. 1 and 2.

Spring 86 of diffuser 80 keeps throttle ring 84 in the diffuser passage 83 in equilibrium against the static and dynamic pressure exerted on the throttle ring 84, as well as the evaporator pressure supplied via line 88 to chamber 87. As the static and dynamic force diminish, at part load, and the evaporator pressure rises, the throttle ring 84 will move more into the diffuser passage 83 than at full load. Rotation of the throttle ring 84 is prevented by stops 89 which are received in grooves 84*a* of the throttle ring 84. From the diffuser passage 83, the compressor output passes into the fixed vanes 82 which are in the form of wedges. The scroll efficiency is improved by mixing out the wakes and jets. With a channel diffuser having wedges 82, the preferred distance (x) for mixing out the wakes and jets is equal to the cover length (l) and represents the distance to the tongue 85 of the scroll.

Although preferred embodiments of the present invention have been illustrated and described, other changes will occur to those skilled in the art. For example, compressor inlet pressure can be supplied as a throttle ring closing force and appropriate seals would be required. Also, the throttle ring can coact with inlet guide vanes for capacity control. It is therefore intended that the scope of the present invention is to be limited only by the scope of the appended claims.

What is claimed is:

1. A centrifugal compressor including:

(a) housing means having an inlet and an annular diffuser passage terminating at an outlet scroll;

(b) impeller means rotatably mounted in said housing between said inlet and said diffuser passage; and (c) diffuser means in said diffuser passage and including:

(1) a fixed vane diffuser having a mixing length at least one half the cover length of said fixed vane diffuser;

(2) a movable annular member located upstream of said fixed vane diffuser for restricting said diffuser passage; and (3) means for moving said movable annular member to restrict said diffuser passage according to the load on said compressor.

2. The compressor of claim 1 wherein said fixed vane diffuser is of a vaned island construction.

3. The compressor of claim 1 wherein said fixed vane diffuser is of a channel diffuser construction having a mixing length approximately equal to the cover length of said fixed vane diffuser.

4. The compressor of claim 1 wherein said movable member has serrations formed therein for receiving the leading edges of the vanes of said fixed vane diffuser.

5. The compressor of claim 1 wherein said movable member has a plurality of axial grooves therein and a base; a plurality of stops are secured to said diffuser passage and extend into said grooves whereby said stops and said grooves coact to permit reciprocating movement of said movable member without rotation and said stop and said base coact to limit closing movement of said movable member.

6. In a centrifugal compressor having a casing and an annular diffuser passage formed therein, an annular diffuser means including:

a fixed wall defining a portion of said annular diffuser passage;

a plurality of fixed vanes located in said passage and secured to said fixed wall and having a mixing length at least one half the cover length of said fixed vanes;

a movable annular member located upstream of said plurality of fixed vanes defining another portion of said annular diffuser passage and mounted for movement with respect to said fixed wall; and means for moving said movable annular member.

7. The diffuser means of claim 6 wherein said movable member has serrations formed therein for receiving the leading edges of said fixed means.

8. The diffuser means of claim 6 wherein said movable member has a plurality of axial grooves therein and a base; a plurality of stops are secured to said diffuser passage and extend into said grooves whereby said stops and said grooves coact to permit reciprocating movement of said movable member without rotation and said stops and said base coact to limit closing movement of said movable member.

* * * * *